US005252045A

United States Patent [19]

Shinoto et al.

[11] Patent Number: 5,252,045

[45] Date of Patent: Oct. 12, 1993

[54] DUAL PISTON RECIPROCATING VACUUM PUMP

[75] Inventors: Hiroshi Shinoto, Hyogo; Nobuhisa Okuyama, Chiba, both of Japan

[73] Assignees: Toyo Engineering Corporation, Tokyo; Mikuni Jukogyo Co., Ltd., Osaka, both of Japan

[21] Appl. No.: 692,369

[22] Filed: Apr. 26, 1991

[30] Foreign Application Priority Data

May 11, 1990 [JP] Japan ..... 2-122450
Sep. 3, 1990 [JP] Japan ..... 2-234090
Sep. 3, 1990 [JP] Japan ..... 2-234091

[51] Int. Cl.[5] ..... F04B 21/04
[52] U.S. Cl. ..... 417/524; 417/454
[58] Field of Search ..... 417/523, 524, 454, 521; 92/169.1

[56] References Cited

U.S. PATENT DOCUMENTS

| | | | |
|---|---|---|---|
| 13,559 | 9/1855 | Yampert | 417/521 |
| 519,383 | 5/1894 | Flood | 417/523 |
| 591,137 | 10/1897 | Miles | 417/523 |
| 3,871,663 | 6/1974 | Zehner | 417/454 |
| 4,008,012 | 2/1977 | Page | 417/454 |
| 4,297,976 | 11/1981 | Bruni et al. | 92/169.1 |
| 4,900,233 | 2/1990 | Ripley | 417/266 |
| 4,954,047 | 9/1990 | Okuyama et al. | 417/203 |
| 4,972,764 | 11/1990 | Ohya et al. | 92/169.1 |
| 5,049,038 | 9/1991 | Searle | 417/246 |

FOREIGN PATENT DOCUMENTS

| | | | |
|---|---|---|---|
| 53-131506 | 11/1978 | Japan | 417/524 |

*Primary Examiner*—Richard A. Bertsch
*Assistant Examiner*—Charles G. Freay
*Attorney, Agent, or Firm*—Flynn, Thiel, Boutell & Tanis

[57] ABSTRACT

A reciprocating vacuum pump characterized in that each part to be lubricated of a crank moving portion and piston moving portions is made oilless, two pistons in the piston moving portions being formed so that their load working lines are aligned, a suction exhaust valve being provided on each of the two pistons. This pump may have a multistage structure in which two pistons extend in a horizontally opposed state. The reciprocating vacuum pump thus constructed is small in size and light in weight, and is substantially free from vibration.

1 Claim, 13 Drawing Sheets

240
242
241
214
212
211
213
23
251
261
250
11
120
13
131
250
17
15
151
14a
120
13
131
11
250
251
23
22
213
212
211
214
241
240
240
241
214
212
213
22

DUAL PISTON RECIPROCATING VACUUM PUMP

FIELD OF UTILIZATION OF THE INVENTION

This invention relates to a completely oilless reciprocating vacuum pump capable of being assembled and disassembled speedily and simply.

DESCRIPTION OF THE PRIOR ART

In a prior art reciprocating vacuum pump, in which the interior of a crank case is oiled, it is necessary to provide a distance piece (spacer) chamber in the immediate vicinity of the crank case, as well as an oil stopper. In a multistage reciprocating vacuum pump, it is necessary to provide the outer wall of a cylinder with an elongated gas passage communicating with suction and exhaust valves provided on a cylinder cover. Therefore, there is a limit to the reduction of the dimensions and weight of a reciprocating vacuum pump, especially, a multistage reciprocating vacuum pump.

Moreover, in a conventional reciprocating vacuum pump, especially, an opposed piston type multistage reciprocating vacuum pump, vibration occurs violently due to the inertial force and imbalance of the reciprocating movements of the pistons. Therefore, this vacuum pump requires a high structural strength, and is difficult to be lightened.

Since a conventional reciprocating vacuum pump is of an oiled type as mentioned above, there is the possibility that the oil is mixed in the gas in a vacuum exhaust passage. Therefore, it is difficult to use such a pump as a vacuum pump for a semiconductor manufacturing apparatus and as a vacuum pump requiring cleanness and a high degree of vacuum.

In a conventional reciprocating vacuum pump shown in FIG. 9, the portion of a piston rod 3023 which is connected to a cross head 3011 extends through a wiper ring box 3028, and then enters a distance piece chamber 3029, in which an oil stopper 3230 is provided on the piston rod 3023 for the oil throwing purpose, while the portion of the piston rod 3023 which is connected to a piston 3021 in a cylinder 3022 is shaft sealed with a packing box-carrying shaft seal unit 3026 to reach the distance piece chamber 3029. Consequently the height (length) of the portion of the vacuum pump which is between a crank case 3019 and a cylinder head cover 3024 increases, and this hampers the miniaturization of the vacuum pump.

In a conventional reciprocating vacuum pump shown in FIG. 15, a piston 4001 is taken out in the following order. (1) A nut 4002 is detached, and a cylinder head cover 4002 is removed. (2) The bolts 4004, 4004 on a bellows type piston rod shaft seal unit 4004 are removed through a distance piece window 4003. (3) A bolt 4005 on an oil stopper 5 is removed through the distance piece window 4003. (4) A bolt 4006 on a wiper ring box 6 is removed through the distance piece window 4003. (5) A cover (not shown) for a crank case window is opened, and the lock nuts 4008 on a piston rod 4008 are removed through the crank case window 4007. (6) The piston 4001 with the piston rod 4008 left fitted, therethrough is withdrawn from a cylinder 4009. (7) A piston nut 4008 is removed, and the piston 4001 is withdrawn from the piston rod 4008. The assembling of these parts is done in the reverse order. Therefore, the assembling of the piston, piston rod, shaft seal unit, oil stopper and wiper ring box of a conventional reciprocating vacuum pump and the disassembling of such a pump require a lot of time and labor. In a miniaturized vacuum pump of this kind, the operation efficiency greatly decreases. Moreover, since a tool, such as a wrench has to be inserted through the distance piece window and a crank case window and operated by feeling, there is the possibility that the piston rod is damaged.

BRIEF DESCRIPTION OF THE DRAWINGS

FIGS. 1–4 show a first embodiment of the present invention, wherein:

FIG. 1 is a general sectional view;

FIG. 2 is a partial sectional view;

FIG. 3 is a perspective view of each part of a delivery valve; and

FIG. 4 is a perspective view of each part of a suction valve.

FIGS. 6–8 show a second embodiment of the present invention, wherein:

FIG. 6 is a partially sectioned, front elevation view,

FIG. 7 is a sectional view of a principal portion, and

FIG. 8 is an enlarged partially sectional view of a principal portion.

FIGS. 10–14 show a third embodiment of the present invention, wherein:

FIG. 10 is a partially sectioned front elevation view;

FIG. 11 is a sectional view of a principal portion;

FIG. 12 illustrates the assembling and disassembling of a moving mechanism of a piston;

FIG. 14 illustrates a lock bolt device; and

SUMMARY OF THE INVENTION

Figure 1:
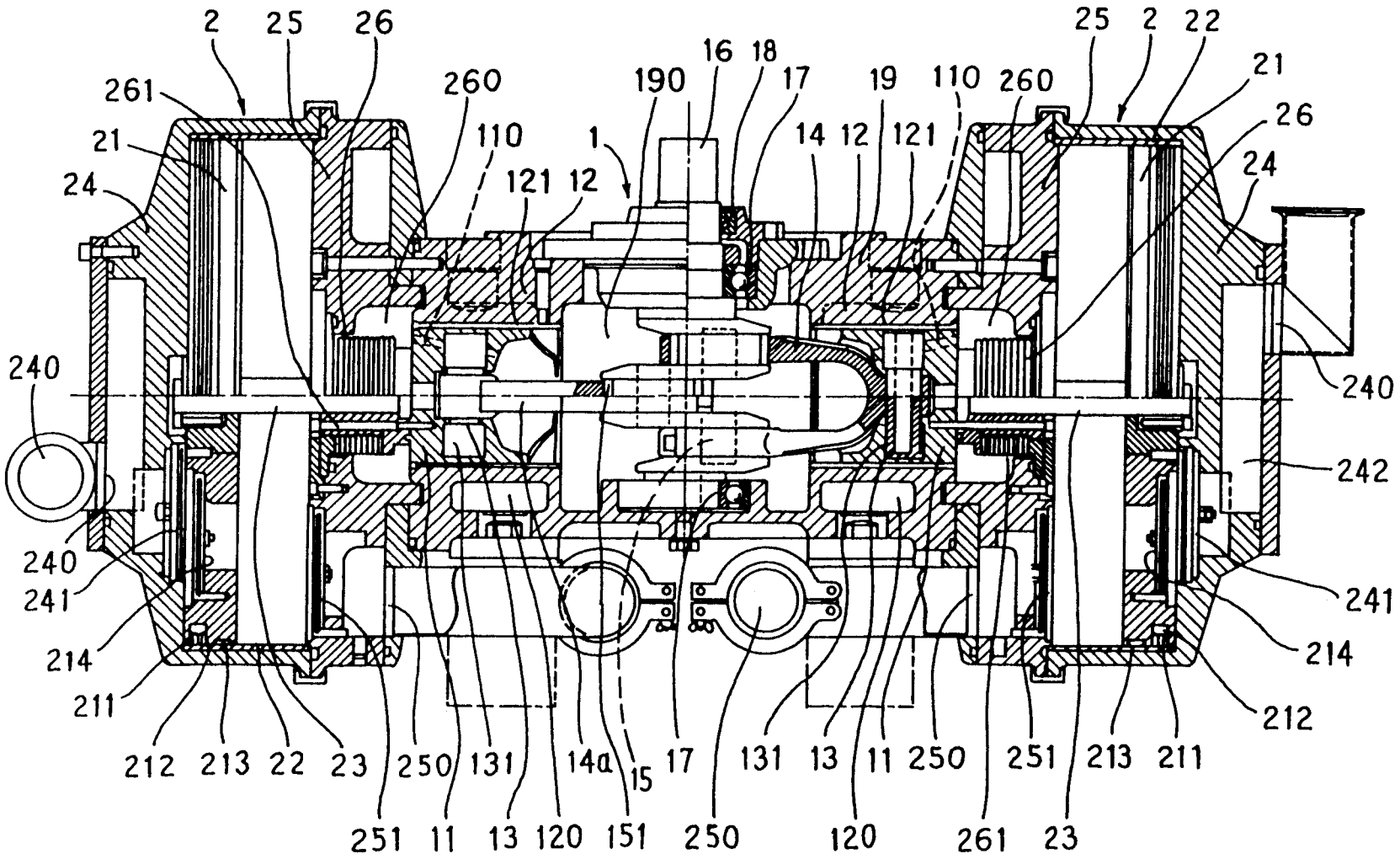

An object of the present invention is to provide a reciprocating vacuum pump capable of reducing the dimensions and weight thereof to an extent that exceeds the limitation placed on a conventional reciprocating vacuum pump, and reducing vibration thereof to an extremely low level. Another object of the present invention is to provide a reciprocating vacuum pump capable of obtaining a clean and high-degree vacuum. Other objects of the present invention will become apparent from the following detailed description thereof.

The present invention relates to a reciprocating vacuum pump employing an oilless system in each section to be lubricated of a crank moving portion and a piston moving portion, having in the piston moving portion two pistons formed so that their load working lines are aligned, and provided with a suction exhaust valve on each of the two pistons.

The present invention has as a first mode of embodiment thereof a multistage reciprocating pump having two pistons formed in a horizontally opposed state.

The present invention includes the following modes of embodiments.

The second embodiment is directed to a reciprocating vacuum pump in which a portion to be lubricated of a crank moving mechanism is made oilless, a shaft seal unit for a piston rod consisting of a bellows gland, a head flange of which is attached to a cylinder bottom cover, and a bottom flange of which is attached to a cross head, whereby the height (length) measured from a crank case to a cylinder head cover can be reduced to a great extent.

The third embodiment is directed to a reciprocating vacuum pump, wherein a cylinder is divided in the circumferential direction into a plurality of axially divisible parts, the ends of which are allowed to project outward to form flanges so that adjacent flanges form a cross-sectionally V-shaped projection when the end portions of adjacent divisional parts are combined, comprising cross-sectionally V-shaped band couplings fitted around these V-shaped projections and then tightened so as to closely combine the end portions of the divisional parts, a piston rod inserted at its free end portion through a piston passing through bore and tightened with a lock bolt from the upper side of a piston head body to center and fix the piston rod, a bellows type piston rod shaft seal unit a head flange of which is fitted firmly between a cylinder bottom cover and a holding plate fixed to the cylinder bottom cover with bolts screwed thereto, and a projection formed at the rear end portion of the piston rod and fitted firmly between a cross head and a bottom flange of the piston rod shaft seal unit fixed to the cross head by inserting bolts into a rod passing through bore in the cylinder bottom cover, the piston rod, bellows type piston rod shaft seal unit, piston and cylinder being inserted in the mentioned order to assemble the parts, which can be detached from one another in the reverse order.

In the multistage reciprocating vacuum pump in the first embodiment of the present invention, the portions to be lubricated of the crank moving portion and piston moving portion are all made oilless, and two pistons in the piston moving portion are formed in a horizontally opposed state so that their load working lines are aligned, each of these two pistons being provided with a suction exhaust valve.

According to the present invention, the crank moving portion represents the concept of a structure including cross heads, cross head guides, connecting rods, cross head pins, a crankshaft, crank pins, crankshaft bearings, crankshaft seal units and a crank case, and the parts to be lubricated thereof include cross head guide bushes, cross head pin bushes, crank pin metals, crankshaft bearings and crankshaft seal units. In order to provide self-lubricating, a solid lubricant-containing sintered alloy, sealed bearings and grease-sealed seals are used.

According to the present invention, the piston moving portion represents the concept of a structure including cylinders, pistons, piston rings, rider rings, piston rods, piston rod shaft seal units and cylinder covers, and the parts to be lubricated thereof include the piston rings, rider rings and piston rod shaft seal units. In order to provide self-lubricating, a material consisting of tetrafluoroethylene resin as a main component is used for the piston rings and rider rings, and bellows type shaft seal units for the piston rod shaft seal units.

DETAILED DESCRIPTION OF PREFERRED EMBODIMENTS

FIGS. 1–4 show an embodiment of the multistage reciprocating vacuum pump according to the present invention.

The vacuum pump in this embodiment consists of a crank moving portion 1 and piston moving portions 2.

The crank moving portion 1 is provided with cross heads 11 adapted to be moved reciprocatingly via a pair of cross guides 12, a pair of connecting rods, **14*a* connected to the cross heads via a cross head pin 13 so that the connecting rods can be turned, a crankshaft 16 connected to these two connecting rods 14*a* via crank pins 15 so that the crankshaft can be turned, a pair of bearings 17 supporting the crankshaft 16, a shaft seal unit 18 for sealing the crankshaft 16, and a crank case 19**.

Each of the cross heads 11 is provided therein with an air flow passage 110 extending therethrough so as to communicate with a hollow space 190 in the crank case and a hollow space 260, in which a bellows type piston rod shaft seal unit 26 to be described later is provided.

Water jackets 120 are provided around the cross head guides 12.

A pair of cross head guide bushes 121, a pair of cross head pin bushes 131 and a pair of crank pin metals 151 are made of a solid lubricant-containing sintered alloy, the pair of crankshaft bearings 17 are sealed bearings, and the crankshaft seal unit 18 a grease-sealed oil seal, so that all of these parts can be oillessly lubricated.

The piston moving portions 2 are provided with two laterally opposed reciprocating piston 21, 21 (the pistons on the right-hand and left-hand portions of FIG. 1 are moved together toward a lower dead point, and moved together toward an upper dead point), a pair of cylinders 22, a pair of piston rods 23 connected at their upper portions to the pistons 21, and at their lower portions to the cross heads 11, a pair of upper cylinder covers 24, a pair of lower cylinder covers 25, a pair of piston rod shaft seal units 26, and a pair of gas communication pipes (not shown).

Figure 3:
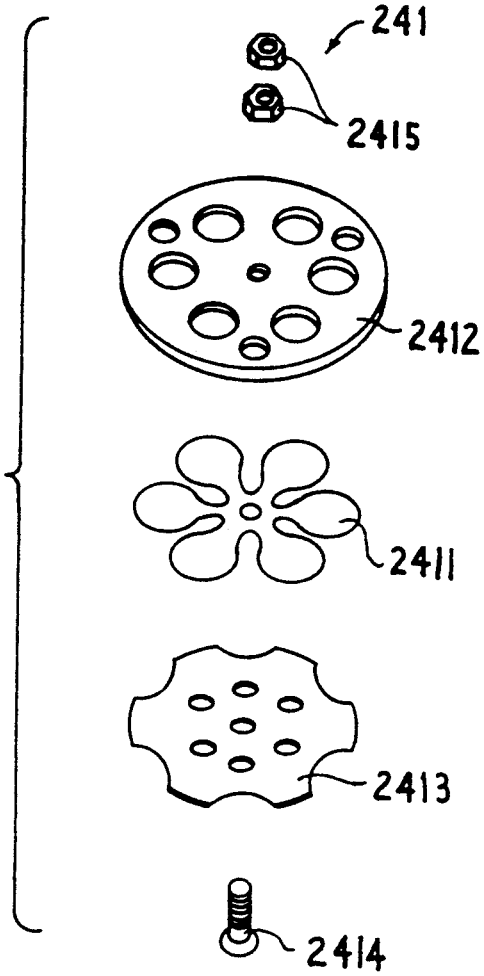
Figure 4:
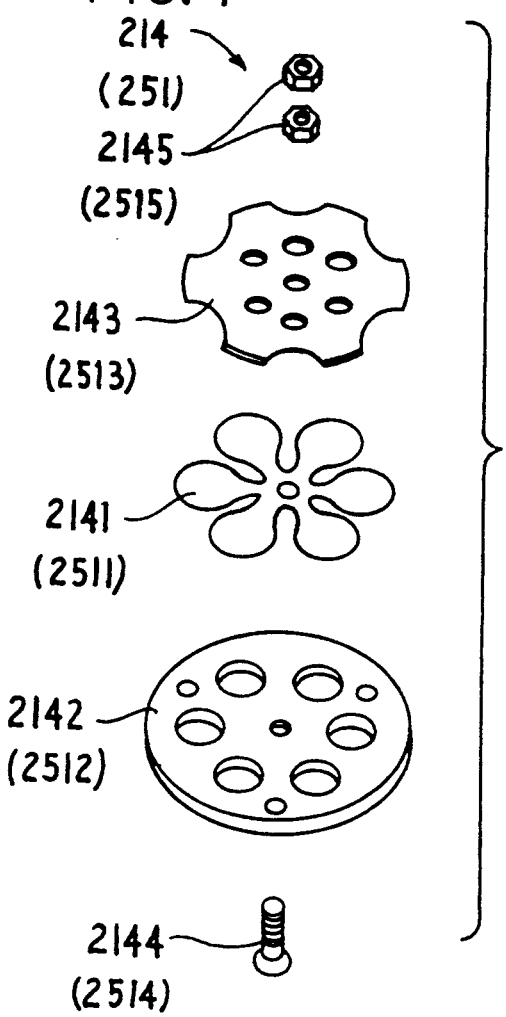
Figure 5:
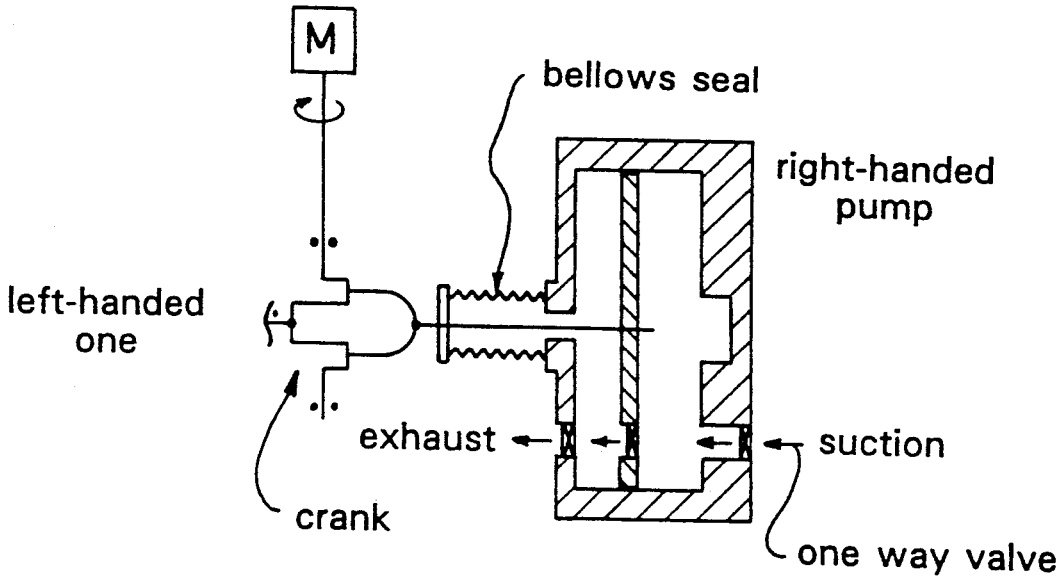
FIG. 5 illustrates the principle of the present invention.

In each piston 21, a piston ring 211 consisting of a tetrafluoroethylene resin as a main component is fitted via a tension ring 212, a rider ring 213 which consists of a tetrafluoroethylene resin as a main component being also fitted therein, the piston ring 211 and rider ring 213 being rendered able to be moved slidingly on the inner surface of the cylinder 22 with no oil supplied thereto. The pair of pistons 21 are provided with suction and exhaust valves 214 on the upper surfaces thereof. Each upper cylinder cover 24 is provided at the portion thereof which corresponds to the suction exhaust valve 214 in the piston 21 with a suction valve 241. Each lower cylinder cover 25 is provided at the portion thereof which correspond to the suction exhaust valve 214 in the piston 21 with a delivery valve 251. As shown in FIG. 4, the suction exhaust valve 214 (delivery valve 251) consists of a valve plate 2141 (2511), a valve seat 2142 (2512), a valve guide 2143 (2513), a valve bolt 2144 (2514) and valve nuts 2145 (2515). As shown in FIG. 3, the suction valve 241 consists of a valve plate 2411, a valve seat 2412, a valve guide 2413, a valve bolt 2414 and valve nuts 2415.

Figure 2:
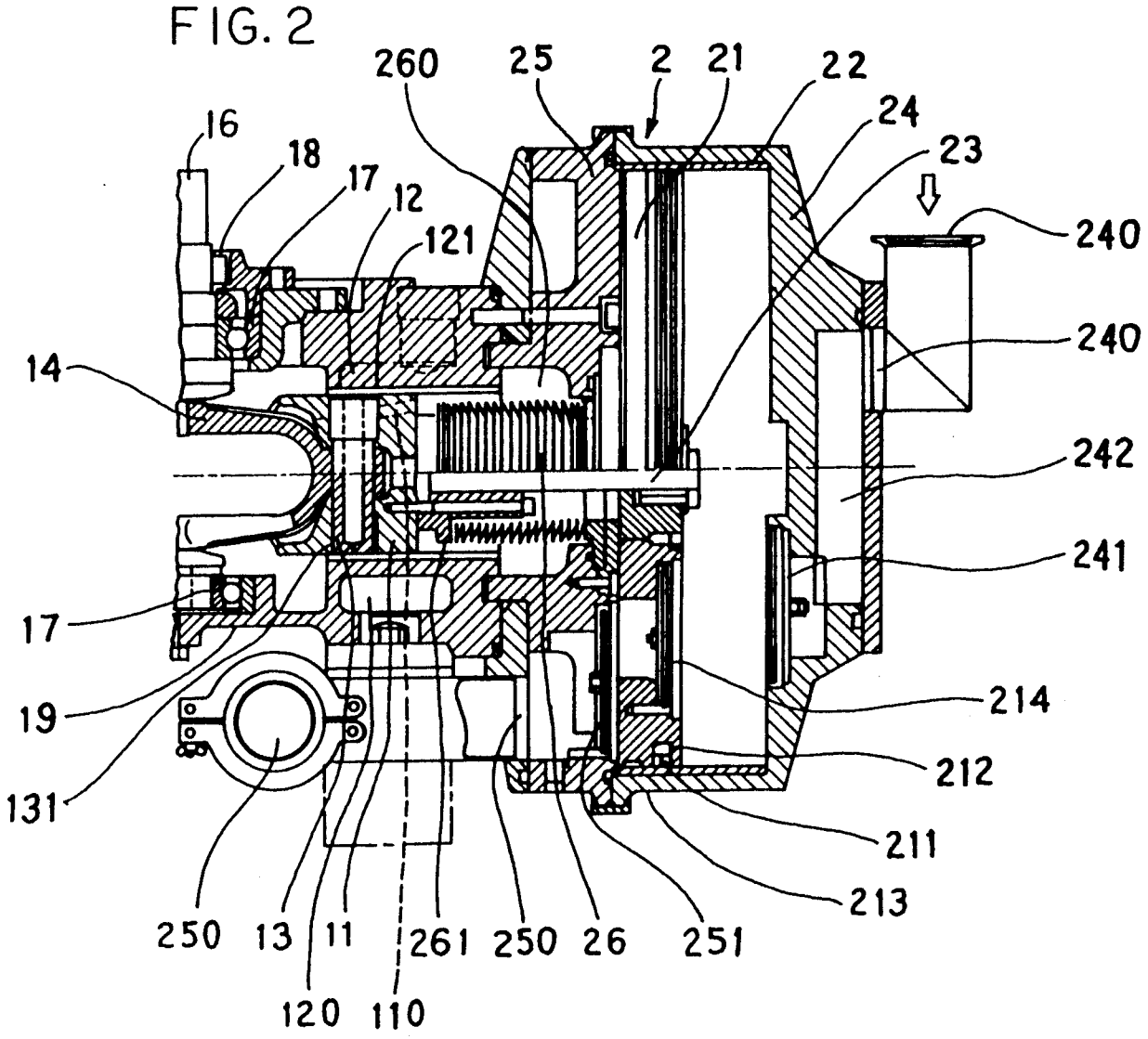

Each piston rod shaft seal unit 26 consists of bellows as shown in FIGS. 1 and 2, one end of which is combined in a sealed state with the lower cylinder cover 25, and the other end of which is combined in a sealed state with the cross head 11 via a bolt 261. A gas communication pipe (not shown) extends from a discharge port 250 in the lower cylinder cover 25 in the right-hand portion of FIG. 1 to a suction port 240 in the upper cylinder cover 24 in the left-hand portion of the same drawing.

In this embodiment, the weight of the opposed reciprocating portions is set equal as in a conventional opposed piston type reciprocating vacuum pump. Also, the uneven inertial force of the rotating portions is balanced. In addition, the cylinders 22 are arranged in a horizontally opposed state around the crankshaft 16 so that the axes of the cylinders 22 are in alignment with each other. The crankshaft 16 is provided with three crank pins 15 which are adjacent to one another with the central crank pin 15 being circumferentially offset relative to the outer two crank pins 15. The central crank pin 15 is joined to the cross head 11 of one piston rod 23 via the straight connecting rod 14, 14*a* the crank pins 15, 15 on both sides of this central crank pin 15 being joined to the cross head 11 of the other piston rod 23 via the bifurcated connecting rod 14.

Operation

When the right piston 21 in the vacuum pump according to the present invention is moved from the upper dead point toward the lower dead point (suction stroke), gas is sucked via the suction port 240 in the right upper cylinder cover 24 into a suction chamber 242, and then sucked via the suction valve 241 into the right cylinder 22. Since the suction exhaust valve 214 in the right piston 21 is closed during this time, the gas in the right cylinder 22 on the side of the lower dead point of the right piston 21 is discharged via the delivery valve 251 in the lower cylinder cover 25 to the discharge port 250 as the right piston 21 is moved toward the lower dead point, passed through the gas communication pipe (not shown), sucked via the suction port 240 in the left upper cylinder cover 24 into the suction chamber 242 (the piston 21 on the left-hand moves to the lower dead point as the piston 21 on the right-hand moves to the lower dead point), and introduced via the suction valve 241 into the cylinder 22. Since the left suction exhaust valve 214 in the piston 21 is closed during this time, the left gas in the cylinder 22 on the side of the lower dead point of the piston 21 is discharged via the delivery valve 251 in the lower cylinder cover 25 to the discharge port 250 as the left piston 21 is moved toward the lower dead point, the resultant gas being introduced to the outside. When each of the right and left pistons 21 is moved from the lower dead point to the upper dead point (compression stroke), the related suction exhaust valve 214 works as a suction valve. Namely, as the right piston is moved from the lower dead point to the upper dead point as shown in FIG. 2, the suction exhaust valve 214 therein is opened due to a difference between the pressure of the gas sucked in the suction stroke and that of a valve plate spring to suck a gas into the right cylinder 22 on the side of the lower dead point of the right piston 21. During this time, the delivery valve 251 is closed. The left piston 21 also carries out a suction operation in the same manner as the right piston 21.

In the vacuum pump according to the present invention, the displacement, which causes couple of force to occur, of the crank pins does not occur, so that the vibration of the vacuum pump during an operation thereof can be completely prevented. Accordingly, even when the wall thickness of the vacuum pump is reduced as compared with that of a conventional vacuum pump of this kind, the structural strength thereof can be kept proper. This contributes to the reduction of the weight and dimensions of this kind of pump. The crank moving portion of the vacuum pump according to the present invention successfully has oilless construction, eliminating a distance piece (spacer) chamber and an oil stopper. Therefore, the length of the piston rod can be reduced, and this correspondingly contributes to the reduction of the dimensions and weight of the vacuum pump. In the vacuum pump according to the present invention, a suction exhaust valve is provided in each piston, an elongated gas passage is not required even when this pump is applied to a multistage reciprocating pump. This correspondingly contributes to the reduction of the dimensions and weight of the vacuum pump. In the vacuum pump according to the present invention, both the piston moving portion and crank moving portion are formed oilless. Accordingly, there is no possibility that the oil is diffused reversely into the vacuum exhaust system and mixed with the air therein, and clean, high-degree vacuum can be obtained.

The second embodiment of the present invention provides a reciprocating vacuum pump capable of reducing the height (length) measured from a crank case to a cylinder cover, to as great an extent as possible, and contributing to the miniaturization of the pump.

To solve the previously-mentioned problems, the reciprocating vacuum pump is constructed as shown in the drawings, i.e., in such a manner that the portion to be lubricated of a crank moving mechanism is formed oilless, piston rod seal units consisting of bellows glands, the head flanges of which are fixed to cylinder bottom covers, and the bottom flanges of which are fixed to cross heads, whereby the height (length) measured from a crank case to a cylinder head cover can be greatly reduced.

According to the present invention, the crank moving mechanism represents the concept of a structure including cross heads, cross head guides, connecting rods, cross head pins, a crankshaft, crank pins, crankshaft bearings, crankshaft seal units and a crank case, and the parts to be lubricated include cross head guides, cross head pins, crank pins, crankshaft bearings and crankshaft seal units. In order to provide self-lubricating, a solid lubricant-containing sintered alloy, sealed bearings and grease-sealed seals are used.

The bellows gland constituting each piston shaft seal unit consists of bellows made by molding or welding a thin metal material into an accordion-shaped contractible structure, and adapted to shaft seal a piston rod.

Figure 6:
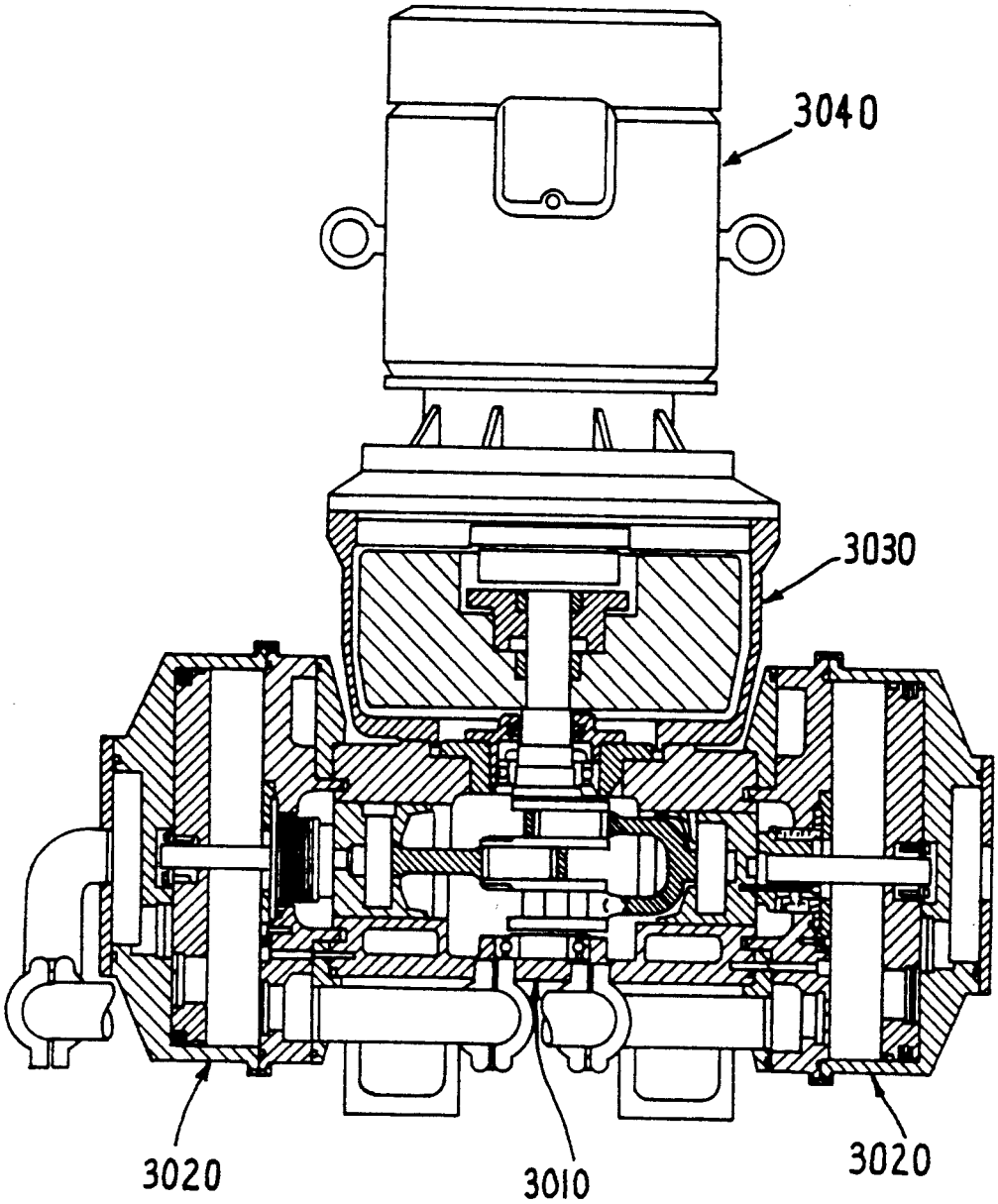
Figure 7:
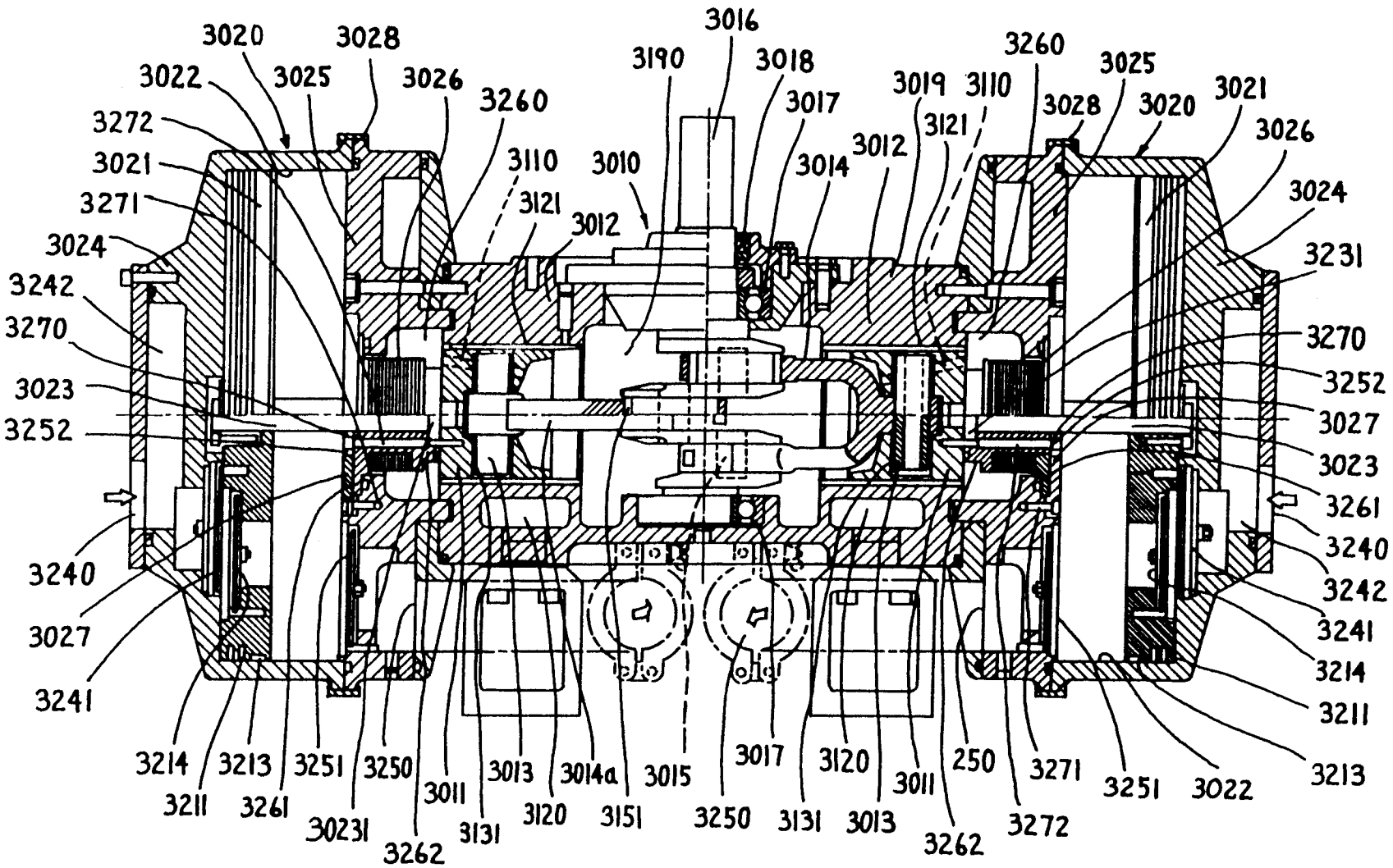
Figure 8:
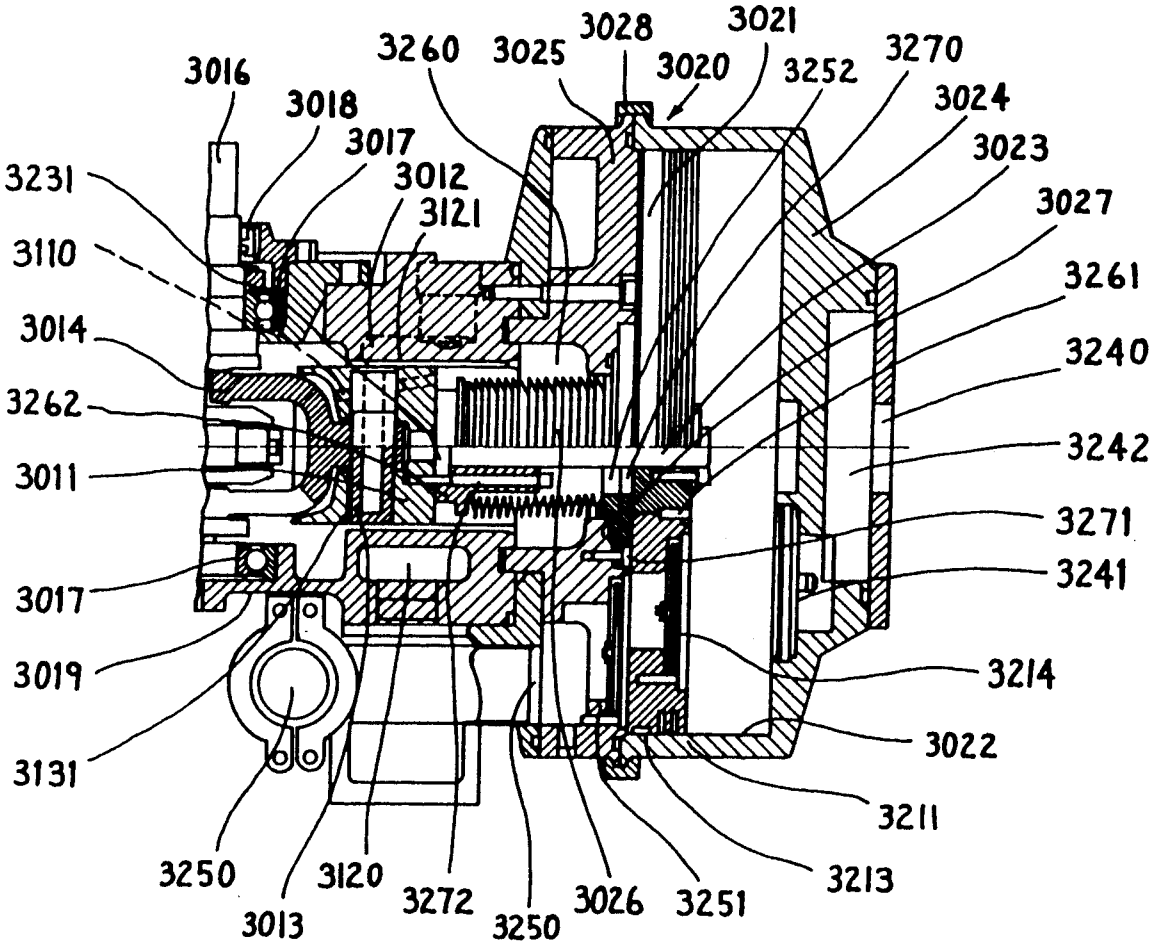
Figure 9:
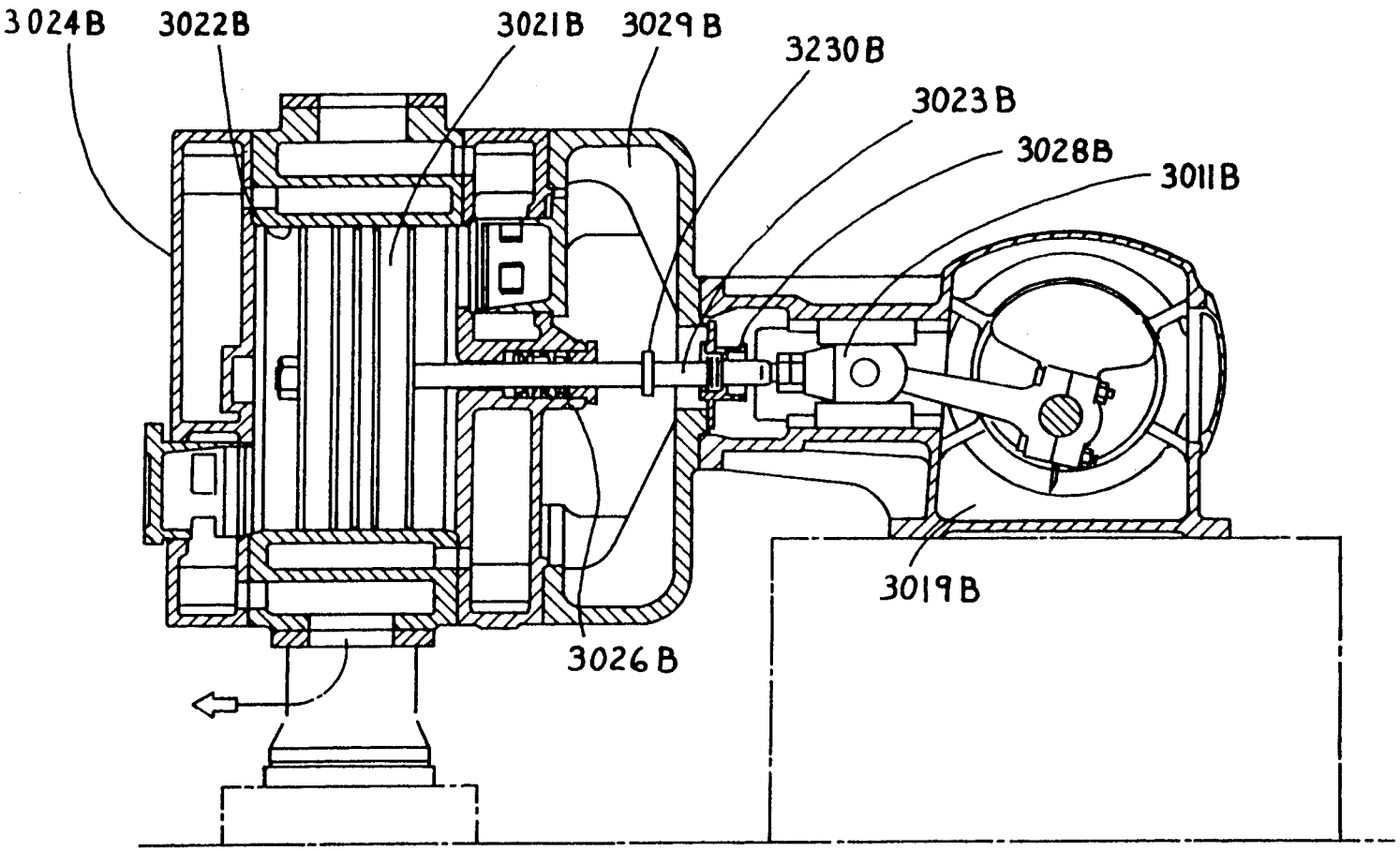
FIG. 9 PRIOR ART
FIG. 9 illustrates a prior art pump.

The second embodiment of the reciprocating vacuum pump according to the present invention is shown in FIGS. 6–8.

The vacuum pump in this embodiment consists of a crank moving mechanism 3010, piston moving mechanisms 3020, a flywheel unit 3030 and a driving motor unit 3040.

The crank moving mechanism 3010 is provided with cross heads 3011 adapted to be moved reciprocatingly via a pair of cross head guides 3012, connecting rods 3014 joined to the cross heads via cross head pins 3013 so that the connecting rods can be turned, a crankshaft 3016 joined to the two connecting rods 3014 via crank pins 3015 so that the crankshaft can be turned, a pair of bearings 3017 supporting the crankshaft 3016, shaft seal units 3018 for sealing the crankshaft 3016, and a crank case 3019.

The two cross heads 3011 are provided therein with air passages 3110 which communicate with a hollow space 3190 in the crank case and hollow spaces 3260 in which bellows gland type piston rod shaft seal units 3026 to be described later are provided.

Water jackets 3120 are provided around the cross head guides 3012.

A solid lubricant-containing sintered alloy is used for a pair of cross head guide bushes 3121, a pair of cross head pin bushes 3131 and a pair of crank pin metals 3151, sealed bearings are used for the pair of crankshaft bearings 3017, and grease-sealed oil seals being used for the crankshaft seal units 3018. These parts can thereby be oillessly lubricated.

The piston moving mechanisms 3020 are provided with two laterally opposed pistons 3021, 3021 (the pistons in the right- and left-hand portions of the drawing are moved together toward a lower dead point, and moved together toward an upper dead point), a pair of cylinders 3022, a pair of piston rods 3023, one end of each of which is connected to the associated piston 3021, and the other end of each of which is fitted firmly in the associated cross head 3011, a pair of cylinder bottom covers 3025 closely combined with cylinder head covers 3024 via V shaped couplings 3028, a pair of piston rod shaft seal units 3026, and a pair of gas communication pipes (not shown).

Each piston 3021 has a piston ring 3211 fitted therein and consisting of a tetrafluoroethylene resin as a main component as well as a rider ring 3213 fitted therein and consisting of the same resin, both of these rings 3211, 3213 being able to be slid oillessly on the inner surface of the relative cylinder 4022. The two pistons 3021 are provided with suction exhaust valves 3214 on the upper surfaces thereof. Suction valves 3241 are provided in the portions of the cylinder head covers 3024 which correspond to the suction exhaust valves 3214 in the pistons 3021. Delivery valves 3251 are provided in the portions of the cylinder bottom covers 3025 which correspond to the suction exhaust valves 3214 in the pistons 3021.

As shown in FIGS. 6 and 7, the valve head flange 3261 of each bellows gland 3026 is fitted firmly by the cylinder bottom cover 3025 and a holding plate 3027 fixed to the cylinder bottom cover 3025 with bolts 3271 screwed thereto, and the bottom flange 3262 is fixed to the cross head 3011 with a bolt 3272 inserted into a rod passing bore 3252 in the cylinder bottom cover 3025 and a rod passing bore 3270 in the holding plate 3027 and screwed to the cross head 3011. The piston rod 3023 is joined to the cross head 3011 by firmly fitting a projection 3231 which is formed at the rear end portion of the piston rod 3023 between the bottom flange 3262 and cross head 3011.

In this embodiment, the weight of the opposed reciprocating portions is set equal as in a conventional opposed piston type reciprocating vacuum pump. Also, the unbalanced inertial force of the rotating portions is balanced. In addition, the cylinder 3022 are arranged in a horizontally opposed state around the crankshaft 3016 so that the axes of the cylinders 3022 are in alignment with each other. The crankshaft 3016 is provided with three crank pins 3015 which are adjacent to one another with the central crank pin 15 being circumferentially offset relative to the outer two crank pins 15 at an angle of 180°, and the central crank pin 3015 is joined to the cross head of one piston rod 3023 via the straight connecting rod 3014*a*, the crank pins 3015, 3015 on both sides of this central crank pin 3015 being joined to the cross head 3011 of the other piston rod 3023 via the bifurcated connecting rod 3014.

When the right piston 3021 in the vacuum pump according to the present invention is moved from the upper dead point toward the lower dead point (suction stroke), a gas is sucked via the suction port 3240 in the right cylinder cover 3024 into a suction chamber 3242, and then sucked via the suction valve 3241 into the cylinder 3022. Since the suction exhaust valve 3214 in the piston 3021 is closed during this time, the gas in the cylinder on the side of the lower dead point of the piston 3021 is discharged via the delivery valve 3251 in the bottom cylinder cover 3025 to the discharge port 3250 as the piston 3021 is moved toward the lower dead point, passed through the gas communication pipe (not shown), sucked via the suction port 3240 in the left upper cylinder cover 3024 into the suction chamber 3242 (the piston 3021 on the left-hand moves to the lower dead point as the piston 3021 on the right-hand moves to the lower dead point), and introduced via the suction valve 3241 into the left 3022. Since the suction exhaust valve 3214 in the left piston 3021 is closed during this time, the gas in the cylinder 3022 on the side of the lower dead point of the piston 21 is discharged via the delivery valve 251 in the lower cylinder cover 3025 to the discharge port 3250 as the piston 3021 is moved toward the lower dead point, the resultant gas being introduced to the outside. When each of the right and left pistons 3021 is moved from the lower dead point to the upper dead point (compression stroke), the relative suction exhaust valve 3214 works as a suction valve. Namely, as the right piston is moved from the lower dead point to the upper dead point as shown in FIG. 7, the suction exhaust valve 3214 therein is opened due to a difference between the pressure of the gas sucked in the suction stroke and that of a valve plate spring to suck a gas into the cylinder 3022 on the side of the lower dead point of the piston 3021. During this time, the delivery valve 3251 is closed. The left piston 3021 also carries out a suction operation in the same manner as the right piston 3021.

According to the present invention, the parts 3121, 3131, 3151, 3017, 3018 to be lubricated of the crank moving portion 3010 are made oillessly lubricatable, whereby the wiper ring box and oil stopper employed in a conventional vacuum pump can be abolished. Since the bellows glands 3026 are joined directly to the cylinder bottom covers 3025 and cross heads 3011, the distance piece chamber employed in a conventional vacuum pump can be abolished. This enables the height (length) measured from the crank case 3019 to a cylinder cover 3024 to be reduced to a great extent, and can contribute greatly to the miniaturization of a reciprocating vacuum pump.

A third mode of embodiment of the present invention provides, in order to solve the previously-mentioned problems, a reciprocating vacuum pump permitting one to simply and speedily take out cylinders, pistons, piston rod shaft seal units and piston rods therefrom after the cylinder head covers are removed.

To achieve the above object, the present invention further provides a reciprocating vacuum pump, which is shown in FIGS. 10–14, wherein a cylinder 4022 is divided in the circumferential direction into a plurality of axially divisible parts, the ends of which are allowed to project outward to form flanges 4221 so that adjacent flanges 4221, 4221 form a cross-sectionally V-shaped projection when the end portions of adjacent divisible parts are combined, comprising cross-sectionally V-shaped band couplings 4028 fitted around these V-shaped projections and then tightened so as to closely combine the end portions of the divisional parts, a piston rod 4023 inserted at its free end portion through a bore 4210 in a piston 4021 and tightened with a lock bolt 4291 from the upper side of a piston head body to center and fix the piston rod 4023, a bellows type piston rod shaft seal unit 4026, a head flange 4261 of which is fitted firmly between a cylinder bottom cover 4025, and a holding plate 4027 fixed to the cylinder bottom cover 4025 with bolts 4271 screwed thereto, and a projection 4231 formed at the rear end portion of the piston rod 4023 and fitted firmly between a cross head 4011 and a bottom flange 4262 of the piston rod shaft seal unit 4026 fixed to the cross head 4011 by inserting bolts 4272 into a rod passing through bore 4270 in the holding plate 4027 and a rod passing through bore 4252 in the cylinder bottom cover 4025, the piston rod 4023, bellows type piston rod shaft seal unit 4026, piston 4021 and cylinder 4022 being inserted in the mentioned order to assemble the parts, which can be detached from one another in the reverse order.

Figure 13A:
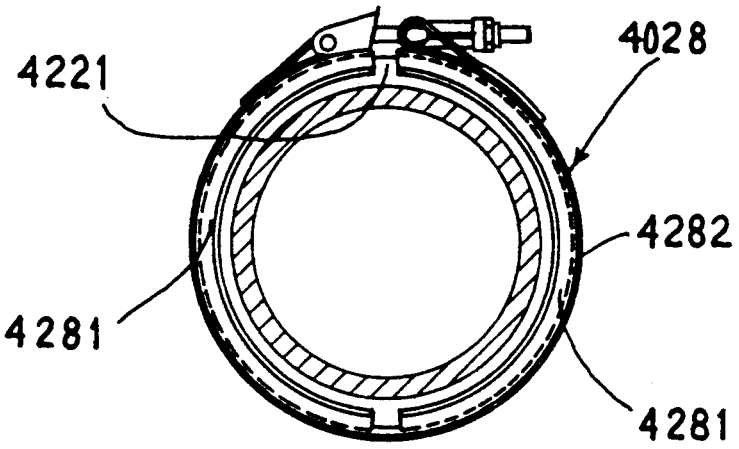
FIGS. 13*a* and 13*b* are sectional views showing the condition of use of a V-shaped coupling and a principal portion thereof.
Figure 13B:
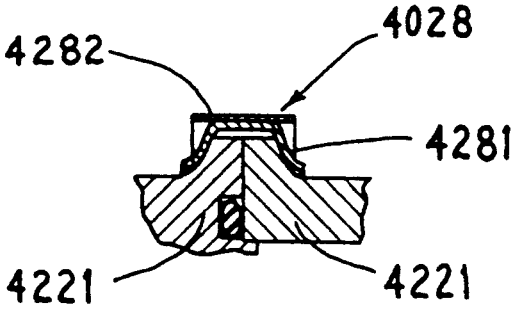

As shown in FIGS. 13(*a*) and 13(*b*) V-shaped band coupling 4028 consists of two divisible V-shaped bands 4281 adapted to be fitted around a V-shaped projection, which is formed when two flanges 4221, 4221 are abutted on each other, and a plate band 4282 used to tighten these V-shaped bands 4281, i.e. the band coupling 4028 is used to closely combine the flanges 4221, 4221 together.

Figure 14:
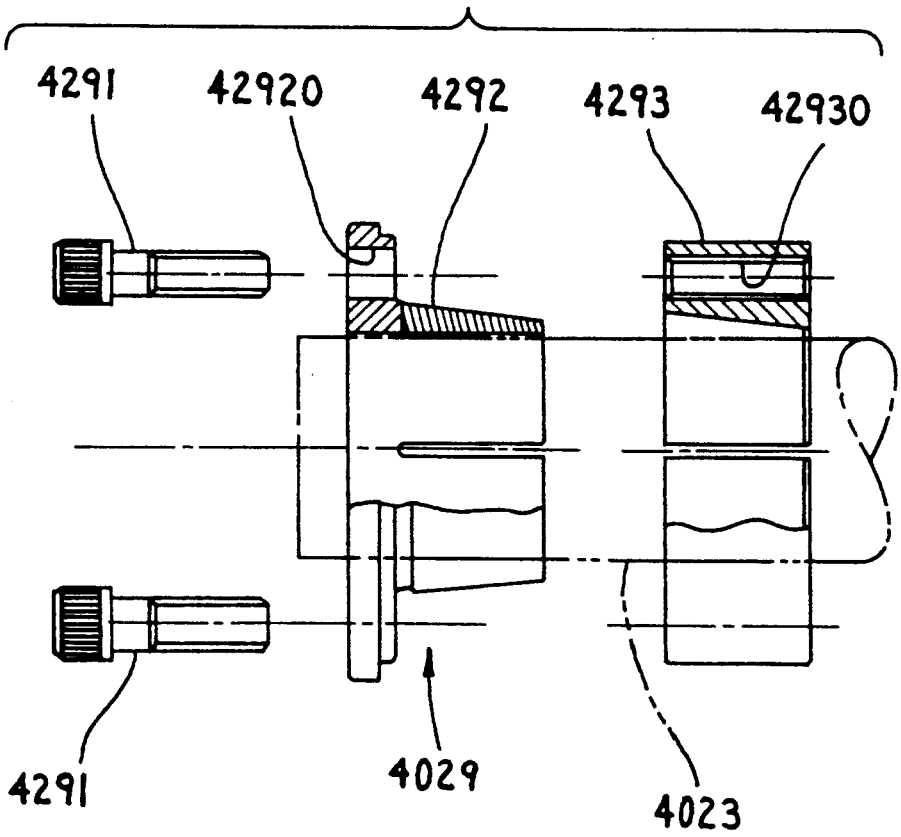
Figure 15:
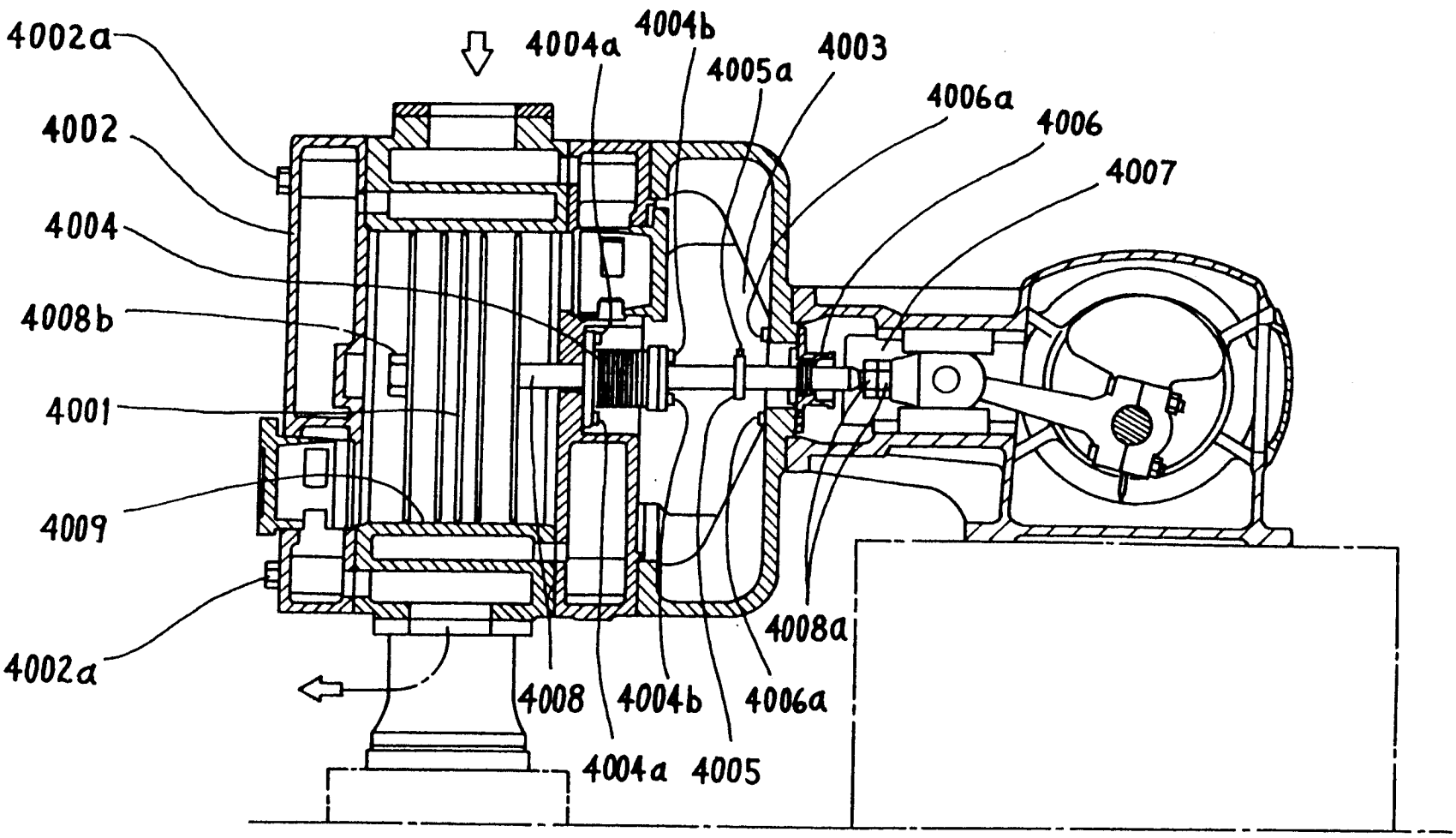
FIG. 15 PRIOR ART
FIG. 15 is a sectional view of a prior art pump.

According to the present invention, a piston rod 4023 is fitted into a piston passing through bore 4210, and a lock bolt device 4029 shown in FIG. 14 is inserted in one direction between the inner circumferential surface of the through bore 4210 and the outer circumferential surface of a rod 4023 to center and fix the rod 4023. This lock bolt device 4029 consists of at least two lock bolts 4291, a member 4292 fitted around the rod, and a slide member 4293. As the lock bolts 4291 are screwed to threaded bores 42920 in the member 4292 and then to threaded bores 42930 in the slide member 4293, the centering of the rod 4023 and the fixing of the rod 4023 in the through bore 4210 firmly can be carried out.

The bellows type piston shaft seal unit 4026 is a contractible bellows formed by molding or welding a thin-walled metal material to an accordion-shaped structure, and is used to shaft seal a piston rod 4023.

An embodiment of the reciprocating vacuum pump according to the present invention is shown in the drawings.

The vacuum pump of this embodiment consists of a crank moving mechanism 4010, piston moving mechanisms 4020, a flywheel unit 4030 and a driving motor unit 4040.

The crank moving mechanism 4010 is provided with cross heads 4011 adapted to be moved reciprocatingly via a pair of cross head guides 4012, connecting rods 4014 joined to the cross heads via cross head pins 4013 so that the connecting rods can be turned, a crankshaft 4016 joined to the two connecting rods 4014 via crank pins 4014 so that the crankshaft can be turned, a pair of bearings 4017 supporting the crankshaft 4016, shaft seal units 4018 for sealing the crankshaft 4016, and a crank case 4019.

Each of the two cross heads 4011 is provided therein with an air communication passage 4110 extending therethrough so as to communicate with a hollow space 4190 in the crank case and a hollow space 4260, in which a bellows gland type piston rod shaft seal unit 4026 to be described later is provided.

Water jacket 4120 are provided around the cross head guides 4012.

A solid lubricant-containing sintered alloy is used for a pair of cross head guide bushes 4121, a pair of cross head pin bushes 4131 and a pair of crank pin metals 4151, and sealed bearings are for the pair of crankshaft bearings 4017, and grease-sealed oil seals being used for the crankshaft seal units 4018. These parts can thereby be oillessly lubricated.

The piston moving mechanisms 4020 are provided with two laterally opposed pistons 4021, 4021 (the pistons in the right- and left-hand portions of the drawing are moved together toward a lower dead point, and moved together toward an upper dead point), a pair of cylinders 4022, a pair of piston rods 4023 one end of each of which is connected to the associated piston 4021, and the other end of each of which is fitted firmly in the associated cross head 4011, a pair of cylinder bottom covers 4025 closely combined with cylinder head covers 4024 via V-shaped couplings 4028, a pair of piston rod shaft seal units 4026, and a pair of gas communication pipes (not shown).

Each piston 4021 has a piston ring 4211 fitted therein and consisting of a tetrafluoroethylene resin as a main component as well as a rider ring 4213 fitted therein and consisting of the same resin, both of these rings 4211, 4213 being able to be slid oillessly on the inner surface of the relative cylinder 4022. The two pistons 4021 are provided with suction exhaust valves 4214 on the upper surfaces thereof. Suction valves 4241 are provided in the portions of the cylinder head covers 4024 which correspond to the suction exhaust valves 4214 in the pistons 4021. Delivery valves 4251 are provided in the portions of the cylinder bottom covers 4025 which correspond to the suction exhaust valves 4214 in the pistons 4021.

Figure 10:
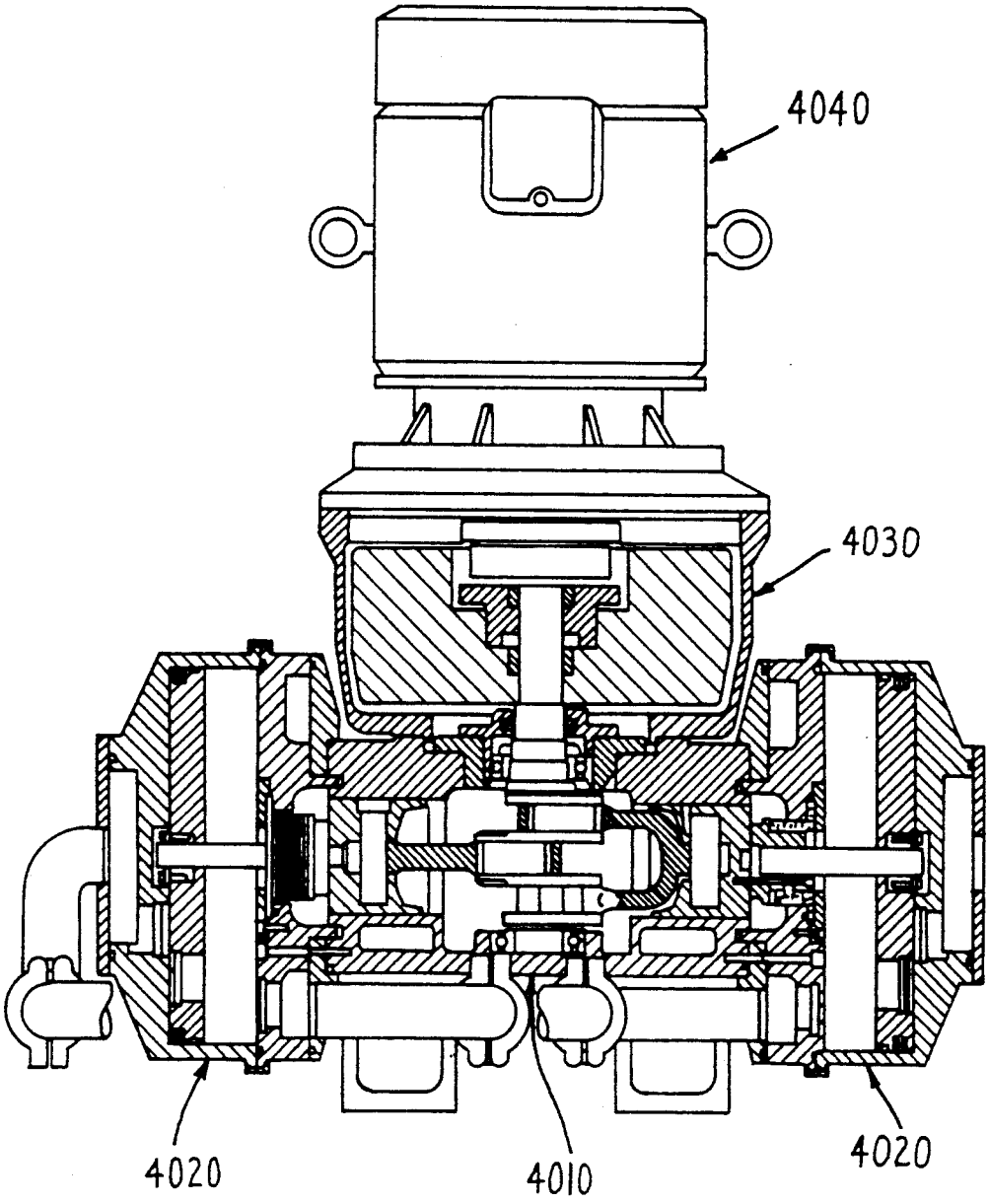
Figure 11:
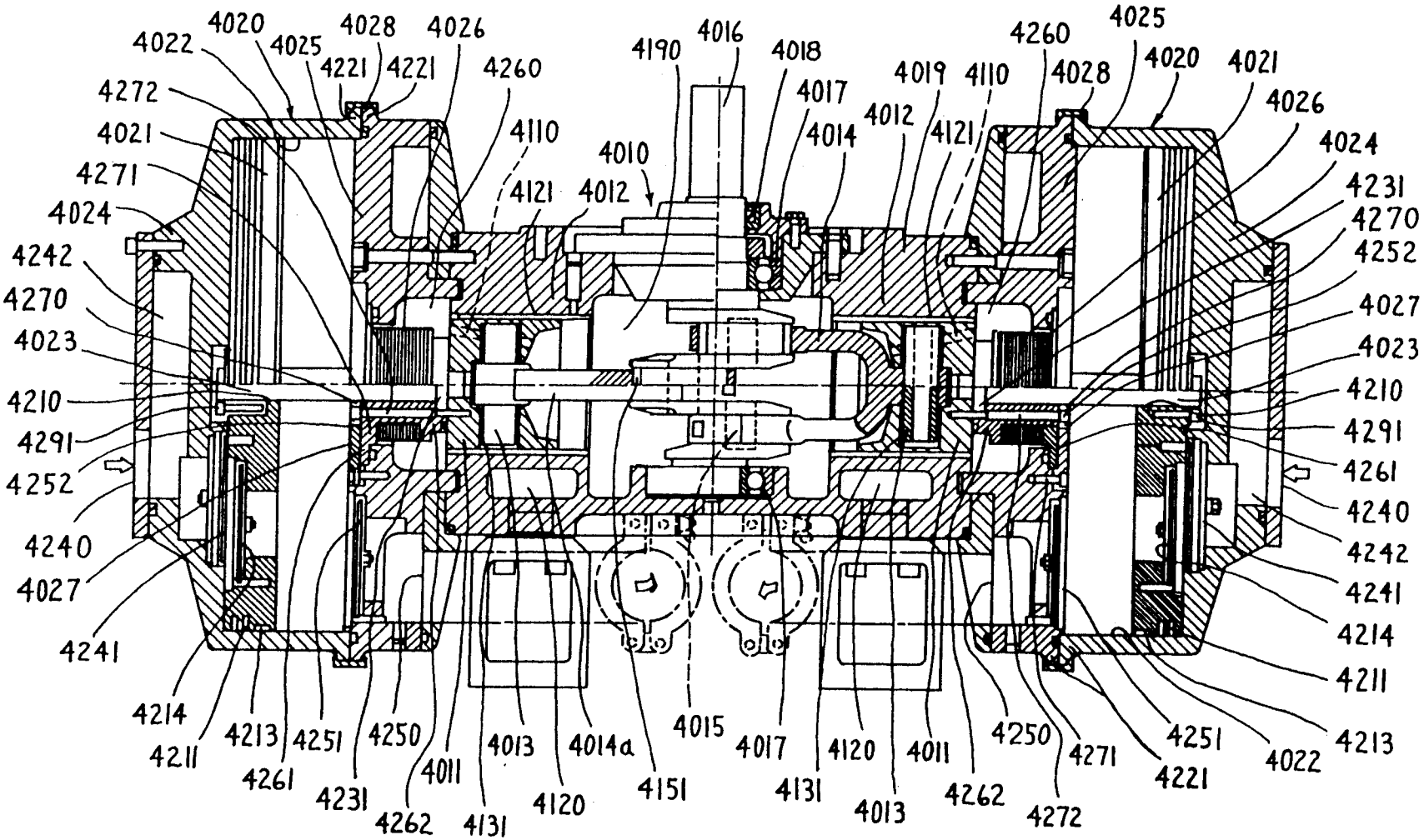
Figure 12:
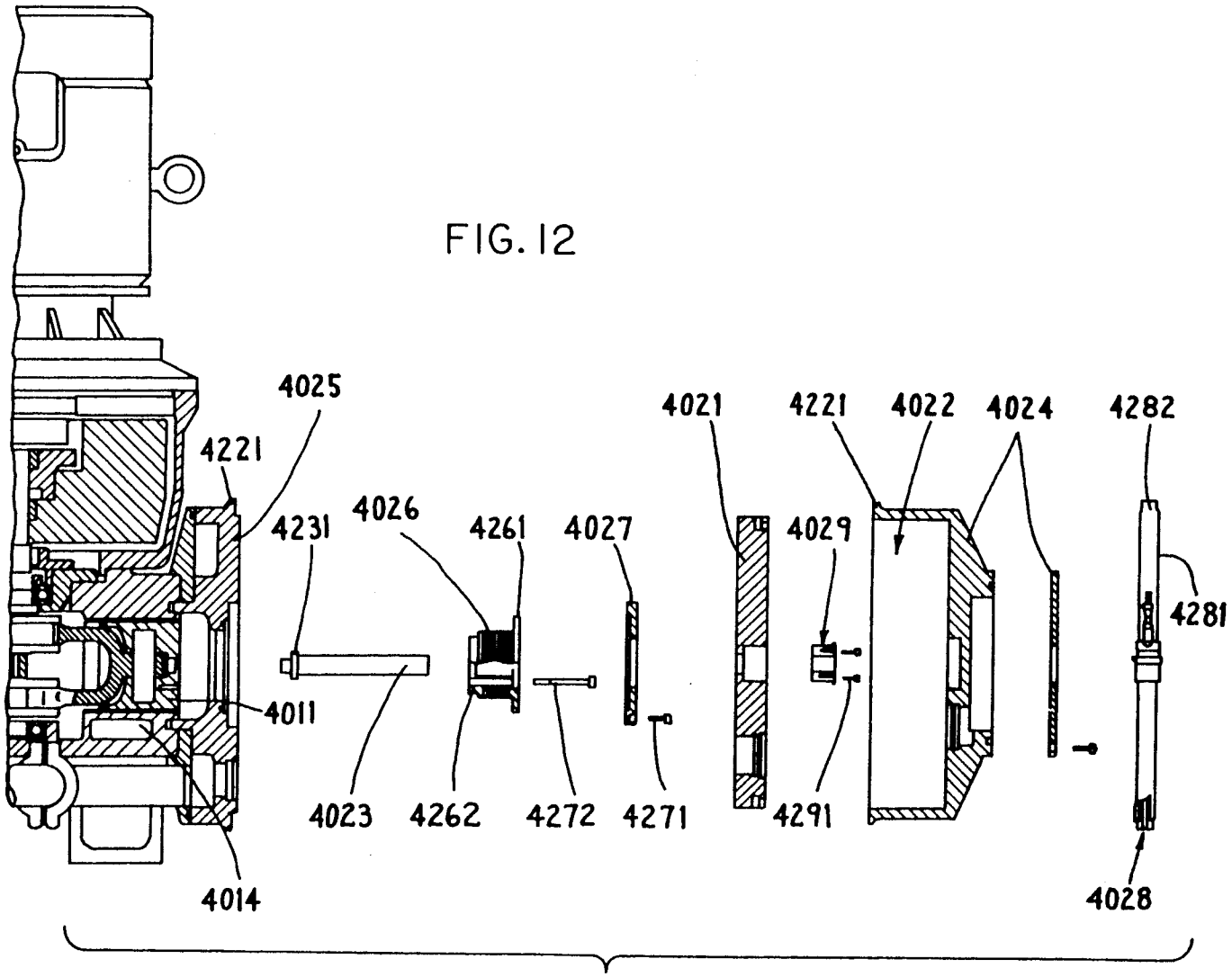

As shown in FIGS. 10 and 11, the valve head flange 4261 of each bellows type piston rod shaft seal unit 4026 is fitted firmly by the cylinder bottom cover 4025 and a holding plate 4027 fixed to the cylinder bottom cover 4025 with bolts 4271 screwed thereto, and the bottom flange 4262 is fixed to the cross head 4011 with a bolt 4272 inserted into a rod passing bore 4252 in the cylinder bottom cover 4025 and a rod passing bore 4270 in the holder plate 4027 and screwed to the cross head 4011. The piston rod 4023 is joined to the cross head 4011 by firmly fitting a projection 4231 which is formed at the rear end portion of the piston rod 4023 between the bottom flange 4262 and cross head 4011.

In this embodiment, the weight of the opposed reciprocating portions is set equal as in a conventional opposed piston type reciprocating vacuum pump. Also, the unbalanced inertial force of the rotating portions is balanced. In addition, the cylinder 4022 are arranged in a horizontally opposed state around the crankshaft 4016 so that the axes of the cylinders 4022 are in alignment with each other. The crankshaft 4016 is provided with three crank pins 4015 which are adjacent to one another with the central crank pin 15 being circumferentially offset relative to the two outer crank pins 15 at an angle of 180°, and the central crank pin 4015 is joined to the cross head of one piston rod 4023 via the straight connecting rod 4014*a*, the crank pins 4015, 4015 on both sides of this central pin 4015 being joined to the cross head 4011 of the other piston rod 4023 via the bifurcated connecting rod 4014.

When the right piston 4021 in the vacuum pump according to the present invention is moved from the upper dead point toward the lower dead point (suction stroke), a gas is sucked via the suction port 4240 in the right cylinder cover 4024 into a suction chamber 4242, and, then sucked via the suction valve 4241 into the right cylinder 4022. Since the suction exhaust valve 4214 in the right piston 4021 is closed during this time, the gas in the right cylinder 4022 on the side of the lower dead point of the right piston 4021 is discharged via the delivery valve 4251 in the bottom cylinder cover 4025 to the discharge port 4250 as the piston 4021 is moved toward the lower dead point, passed through the gas communication pipe (not shown), sucked via the suction port 4240 in the left upper cylinder cover 4024 into the suction chamber 4242 (the piston 4021 on the left-hand moves to the lower dead point as the piston 4021 on the right-hand moves to the lower dead point), and introduced via the suction valve 4241 into the left cylinder 4022. Since the suction exhaust valve 4214 in the left piston 4021 is closed during this time, the gas in the left cylinder 4022 on the side of the lower dead point of the left piston 4021 is discharged via the delivery valve 4251 in the lower cylinder cover 4025 to the discharge port 4250 as the piston 4021 is moved toward the lower dead point, the resultant gas being introduced to the outside. When each of the right and left pistons 4021 is moved from the lower dead point to the upper dead point (compression stroke), the associated suction exhaust valve 4214 works as a suction valve. Namely, as the right piston is moved from the lower dead point to the upper dead point as shown in FIG. 11, the suction exhaust valve 4214 therein is opened due to a difference between the pressure of the gas sucked in the suction stroke and that of a valve plate spring to suck a gas into the cylinder 4022 on the side of the lower dead point of the piston 4021. During this time, the delivery valve 4251 is closed. The left piston 4021 also carries out a suction operation in the same manner as the right piston 4021.

Therefore, in order to draw out the piston 4021 from the reciprocating vacuum pump according to the present invention, the plate band 4281 on the V-shaped band coupling 4028 is loosened, and the cylinder 4022 and cylinder head cover 4024 are taken out. The lock bolts 4291 in the lock bolt unit 4029 are loosened, and the piston 4021 is taken out from the piston rod 4023. The bolts 4271, 4272 in the holding plate 4027 are loosened, and the bellows type shaft seal unit 4026 is taken out, the piston rod 4023 being then ready to be taken out.

In order to set the piston 4021 in the cylinder 4022, these steps are carried out reversely.

According to the present invention, the assembling and disassembling operations in the piston moving mechanisms 4020 can be carried out in one direction. Therefore, the reduction of the operation time and the facilitation of the operations can be achieved, and the improvement of the reliability of the operations can be expected. This can prevent damage to the piston moving mechanisms 4020.

What is claimed is:

1. A reciprocating vacuum pump, comprising:

a central, oil-free, crank-moving portion including a crank case, a rotatable crankshaft journalled in said crank case, said crankshaft having two crank pin means thereon on diametrically opposite sides thereof, a pair of cross heads slidably journalled in said crank case on diametrically opposite sides of said crank shaft, and a connecting rod extending between each of said cross heads and the adjacent one of said crank pin means;

a pair of outer, oil-free, piston-moving portions each including a reciprocable piston rod carried by one of said cross heads and extending outwardly therefrom, a piston secured on each piston rod so that said pistons move in opposite directions in response to rotation of said crankshaft, a cylinder surrounding each piston so that each piston divides its associated cylinder into two separate chambers, a one-way suction exhaust valve means in each piston for permitting fluid flow between said chambers only in one direction, each cylinder having a one-way valve means connected to each of its respective chambers so that reciprocation of said pistons is effective to flow a working fluid unidirectionally through said cylinders, said cylinders each including a cylinder bottom cover at the inner end thereof and a cylinder head cover at the outer end thereof; and sealing means between said crank-moving portion and said two piston-moving portions for preventing fluid flow therebetween said sealing means comprising bellows glands having head flanges attached to said cylinder bottom covers, said bellows glands having bottom flanges which are attached to said cross heads, whereby the distance measured from said crank case to a cylinder head cover can be reduced to a great extent.

* * * * *